United States Patent [19]

Metz

[11] Patent Number: 4,774,781

[45] Date of Patent: Oct. 4, 1988

[54] INDICIA DISPLAY

[76] Inventor: Hugh E. Metz, 822 S. Rockport Rd., Boonville, Ind. 47601

[21] Appl. No.: 59,595

[22] Filed: Jun. 8, 1987

[51] Int. Cl.[4] ..... G09F 19/14

[52] U.S. Cl. ..... 40/453

[58] Field of Search ..... 40/453, 454; 446/85; 434/172

[56] References Cited

U.S. PATENT DOCUMENTS

| | | | |
|---|---|---|---|
| 385,912 | 7/1888 | Coote | 40/453 |
| 942,498 | 12/1909 | Heinemann | 40/453 |
| 1,412,204 | 4/1922 | Derby | 434/172 |
| 2,847,783 | 8/1958 | Anderson | 40/453 |
| 3,834,051 | 9/1974 | Barnes, Jr. et al. | 40/900 |
| 4,233,767 | 11/1980 | Hryhorczuk | 40/453 |
| 4,282,669 | 8/1981 | Rieumont | 40/453 |

FOREIGN PATENT DOCUMENTS

| | | | |
|---|---|---|---|
| 607841 | 6/1926 | France | 40/453 |
| 246914 | 3/1926 | Italy | 40/453 |
| 284967 | 8/1952 | Switzerland | 40/453 |
| 280449 | 11/1927 | United Kingdom | 40/453 |
| 314533 | 6/1929 | United Kingdom | 40/453 |

*Primary Examiner*—Gene Mancene
*Assistant Examiner*—Michael Lynch
*Attorney, Agent, or Firm*—Warren D. Flackbert

[57] ABSTRACT

An indicia display characterized by indicia units, either letters or numbers, which, when assembled, create a different visual image depending upon the viewing angle. In addition to direct viewing at a preselected angle, the direct viewing of the reflected image is available through use of a mirror or reflecting surface (where the reflected image is the backside of each indicia unit). The indicia units may be grouped either horizontally or vertically, where the number of indicia units involved is not limited. Virtually all letters, for example, are combinable, i.e. so that each indicia unit presents a different pair of letters, depending upon viewing angle. The indicia units may be carved from wood, cast from metal or molded from a plastic resin.

8 Claims, 1 Drawing Sheet

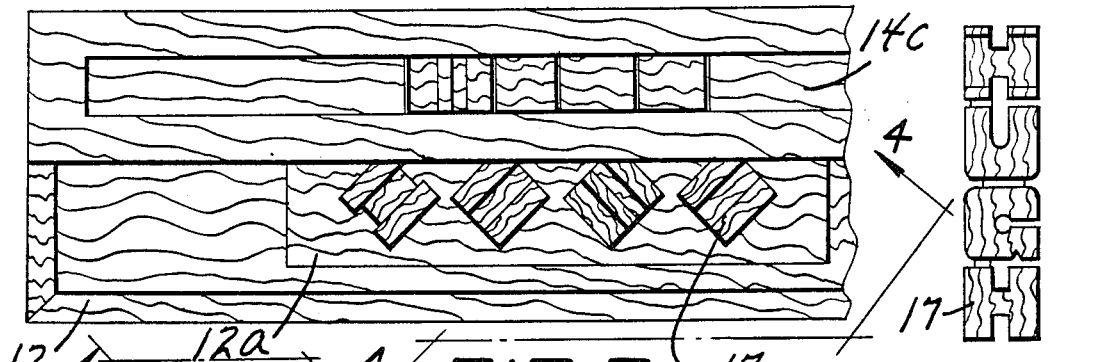
FIG. 2
FIG. 6
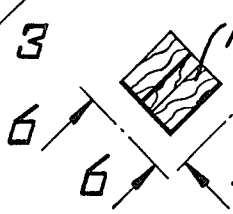
FIG. 5
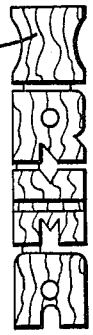
FIG. 7
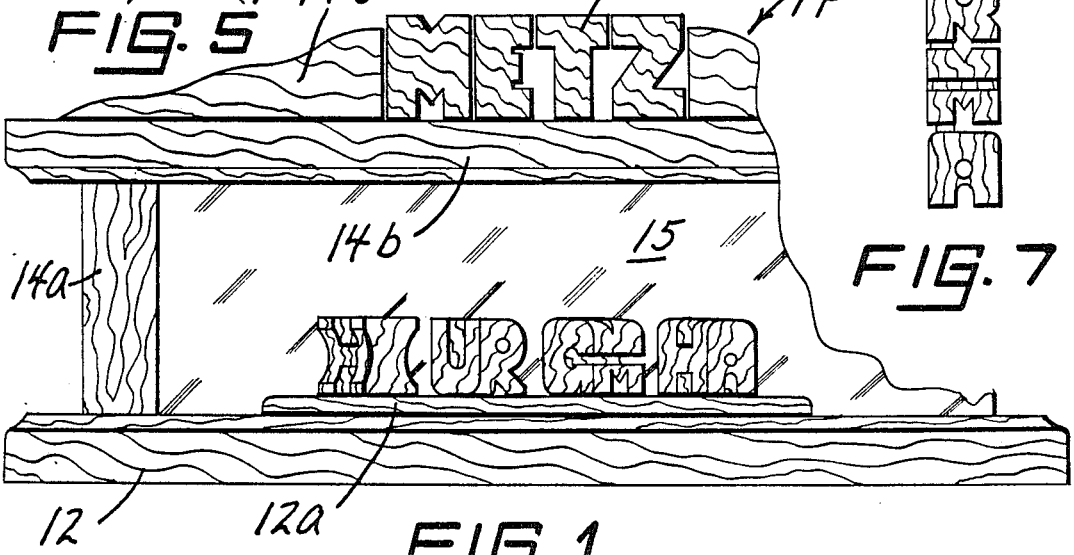
FIG. 1
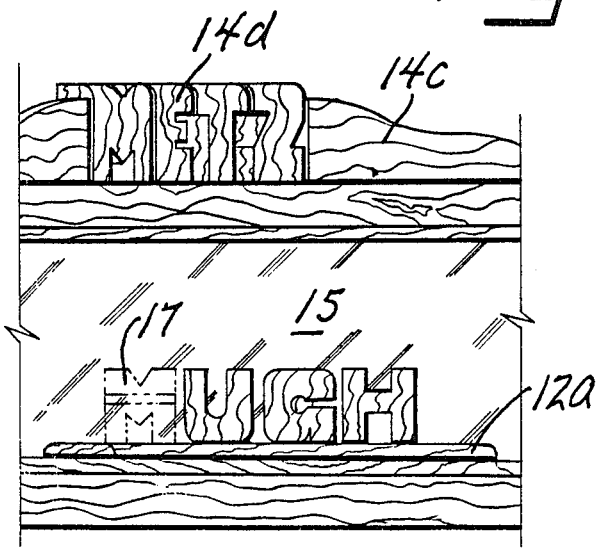
FIG. 3
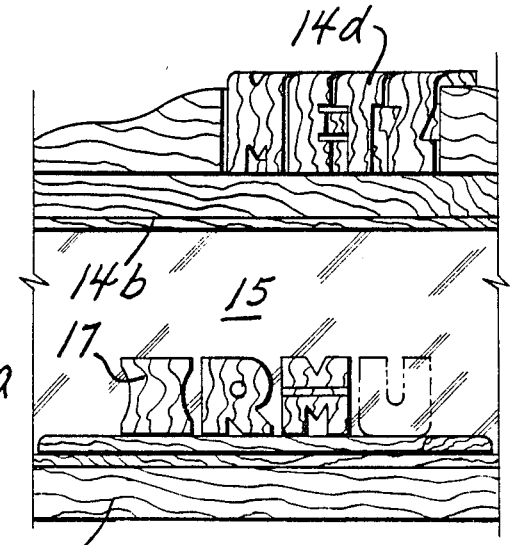
FIG. 4

INDICIA DISPLAY

As is known, interest in items involving the display of names and/or indicia is continual, both for identification and/or novelty reasons. The invention is directed to such general purpose, but presents an arrangement of letters, for example, which, when viewed from different visual angles, display different letter combinations, as the first names of two individuals.

The aforesaid indicia unit arrangement may be horizontally disposed, vertically disposed, and even include a mirrored surface for indicia reflection (an image reversal of the back side of each indicia unit) and, therefore, afford further variety in presentation. The indicia units of the aforesaid arrangement may be either individually carved, as from wood, cast from metal or molded from a plastic resin, for example, and are suitably assembled, as desired.

In any event, a better understanding of the present invention will become more apparent from the following description, taken in conjunction with the accompanying drawing, wherein

DESCRIPTION OF THE FIGURES

FIG. 1 is a view in front elevation of one form of indicia display in accordance with the teachings of the present invention;

FIG. 2 is a top plan view of the first indicia display form, looking downwardly onto FIG. 1;

FIG. 3 is a view in front elevation, taken at line 3—3 on FIG. 2 and looking in the direction of the arrows, illustrating what is visible from one viewing angle;

FIG. 4 is another view in front elevation, in this instance, however, taken at line 4—4 on FIG. 2 and looking in the direction of the arrows, illustrating what is visible from another viewing angle;

FIG. 5 is a top plan view of an alternative form of indicia display in accordance with the teachings of the present invention;

FIG. 6 is a view in elevation, taken at line 6—6 on FIG. 5 and looking in the direction of the arrows, illustrating what is visible from one viewing angle; and, FIG. 7 is another view in elevation, in this instance, however, taken at line 7—7 on FIG. 5 and looking in the direction of the arrows, illustrating what is visible from another viewing angle.

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modification in the illustrated devices, and such further applications of the principles of the invention as illustrated therein being contemplated as would normally occur to one skilled in the art to which the invention relates.

Referring now to FIGS. 1, 2, 3 and 4, the indicia display, in one invention form, is defined by a base member 12 and a back member 14, the latter including vertical supports **14*a* and a horizontal beam 14*b*. In a typical arrangement, the horizontal beam 14*b* includes end portions 14*c* and certain preselected letter indicia 14*d* all of which appear to be separate, but, in fact, are fabricated from a single piece of material to give such appearance (except when spaces, intervals, periods or the like, are required). Additionally, a mirror or like reflective surface 15 is disposed on the front of the back member 14** (for reasons which will become more apparent from the following discussion).

The base member 12 includes a horizontally disposed bar **12*a* on which is disposed an arrangement of oblong, in horizontal section, indicia units 17, each representing, in this instance, two different letters, each on selected pairs of adjacent faces, depending upon the viewing angle. The indicia units 17** are grouped horizontally and, in the illustrated example, present either the name H U G H or the name I R M A.

In other words, depending upon the viewing angle, either H U G H or I R M A are presented and, as well, while not apparent, the reflected view, on the mirror 15, of the in-line outline of the letters forming H U G H and I R M A (illustrated, for purposes of example, by other representatives letters in broken lines in FIGS. 3 and 4, i.e. the H and I are removed and other letters substituted. In other words, the faces of the indicia units 17 variously appear directly and by reflection.

Another embodiment of the invention is shown in FIGS. 5, 6 and 7, where, in such instance, the indicia units 17 are arranged vertically instead of horizontally. Again, and dependent upon the viewing angle, the letters on adjacent faces of each indicia unit, for either H U G H or I R M A, the sample illustration, appear. While not shown, a mirror could also be employed to capture both direct and reflected indicia unit 17 displays.

It should be evident, therefore, that through careful indicia unit 17 selection, in this instance letters, two letters are available from each presented indicia unit 17 and in most all combinations. The indicia units 17 are readily assembled, as through the use of an adhesive in the case of the horizontal indicia units (FIGS. 1, 3 and 4) or may be fabricated from one piece of material in the instance of vertical indicia units (FIGS. 6 and 7).

The indicia display presented herein adds a decorative effect to and at a use site. Specifically, the combined lettering achieved by each indicia unit affords custom personalization for the owner/user. In other words, and while the drawing illustrates a name presentation, place location is equally feasible, as, for example, L A K E E R I E. Additionally, a variety, in number, of indicia units are adaptable for use, as M A R T H A J E A N, where, in such instance, the extra indicia units would have certain blank surfaces.

The indicia display described hereabove is susceptible to various changes within the spirit of the invention, including, by way of example, proportioning; the selection of employed material, as stated above; the manner of assembly; the particular indicia number or letter configuration; and, the like. Thus, the preceding should be considered illustrative and not as limiting the scope of the following claims.

I claim:

1. A message unit comprising a block having a bottom wall, a top wall and pairs of opposing side walls, a front of one of said pairs of opposing side walls formed to present a preselected first indicia and the front of an adjacent other of said pairs of opposing side walls formed to present a preselected second indicia, where the assembly of said message units present a first collected message on the fronts of said pairs of opposing side walls discernible at a first viewing angle and a second collected message on the adjacent fronts of said other of said pairs of opposing side walls discernible at a second viewing angle, wherein said first indicia and said second indicia are defined by cut-out portions.

2. The message unit of claim 1 where said assembly of said message units is in a horizontal row.

3. The message unit of claim 1 where said assembly of said message units is in a vertical row.

4. The message unit of claim 1 where said fronts of said assembly of said message units each angle equally with respect to a vertical plane.

5. The message unit of claim 1 where said assembly of said message units is disposed in front of a reflective surface serving to facilitate a visual image reversal thereon from the backs of adjacent side walls in a row of message units.

6. The message unit of claim 5 where said assembly of said message units in said row presents a different message at a first viewing angle and at a second viewing angle, and where said message is reversed when viewed on said reflective surface at said first viewing angle and said second viewing angle.

7. The message unit of claim 5 where said reflective surface is in a generally vertical plane, and where said assembly of message units is disposed at an angular relationship therewith.

8. The message unit of claim 7 where said angular relationship permits viewing of the same face of each message unit at the same viewing angle.

* * * * *